US005279437A

United States Patent [19]

Kupersmit

[11] Patent Number: 5,279,437

[45] Date of Patent: Jan. 18, 1994

[54] COLLAPSIBLE CARGO CONTAINER FOR AIRCRAFT

[76] Inventor: Julius B. Kupersmit, 299 W. 12th St., New York, N.Y. 10014

[21] Appl. No.: 986,495

[22] Filed: Dec. 7, 1992

[51] Int. Cl.[5] ..... B65D 19/02

[52] U.S. Cl. ..... 220/4.28; 220/4.33; 220/7; 220/1.5

[58] Field of Search ..... 220/4.28, 4.33, 4.34, 220/7, 1.5

[56] References Cited

U.S. PATENT DOCUMENTS

| | | | |
|---|---|---|---|
| 1,224,234 | 5/1917 | Taber | 220/4.33 |
| 1,338,608 | 4/1920 | Bench | 220/7 |
| 2,540,698 | 2/1951 | States | 220/7 |
| 3,552,466 | 1/1971 | Fairchilds | 220/7 |
| 3,968,896 | 7/1976 | Barnes, Jr. et al. | 220/7 |
| 5,050,536 | 9/1991 | Baker | 220/7 |

FOREIGN PATENT DOCUMENTS

| | | | |
|---|---|---|---|
| 2102003 | 7/1971 | Fed. Rep. of Germany | 220/4.33 |
| 2033875 | 1/1978 | United Kingdom | 220/7 |
| 2039850 | 8/1980 | United Kingdom | 220/7 |

*Primary Examiner*—Joseph Man-Fu Moy
*Attorney, Agent, or Firm*—Charles E. Temko

[57] ABSTRACT

A collapsible cargo container particularly suited for aircraft and other uses in which rigid foldable side walls are interconnected to a rigid pallet element. The roof of the container is made of flexible high tensile strength material, and is interconnected to the upper edge area of the side walls so as to be foldable therewith. In one embodiment, provision is made for supporting the roof element in other than planar condition to accommodate a domed shaped cargo bay area in which the device is disposed.

7 Claims, 4 Drawing Sheets

COLLAPSIBLE CARGO CONTAINER FOR AIRCRAFT

BACKGROUND OF THE INVENTION

This invention relates generally to the field of collapsible reusable shipping containers, and more particularly to an improved form thereof suited for aircraft use within a cargo compartment which may have a non-planar roof line.

Most commercial aircraft used for shipping cargo have fuselages, of circular or ovate cross-section for reasons related to aerodynamics. Within this shape, a horizontal deck or floor is provided to support cargo. The area beneath the floor may be used for fuel storage and the like. The curved roof line of the cargo compartment has no planar ceiling, and unless containers are shaped to utilize the area immediately beneath the roof, this valuable cargo space is wasted.

It is known in the art to provide shipping containers having other than horizontal roof lines which are referred to as so-called "igloo" containers. Such containers have curved roof lines formed of molded materials, and while useful, they suffer from several disadvantages, the principal ones being high cost of manufacture, substantial weight, and more importantly, they are not normally capable of being collapsed to flattened condition for storage or return shipment.

In my prior patent, U.S. Pat. No. 4,860,972, granted Aug. 29, 1991, there is described a collapsible shipping container of "igloo" type, which is capable of being collapsed to generally planar condition, representing a substantial contribution to the art. However, this container has certain disadvantages in that in collapsed condition, it forms three separate parts. Further, the roof element is of substantial area, and requires substantial space in order to place it in supported condition prior to folding the same. During assembly, the roof element is not as easily manipulated into position overlying the erected side wall elements as might be desired.

The same problem exists to a substantial degree in the case of containers of the type in which the roof line of the cargo bay is planar rather than domed. Large generally rectangular containers using a separate roof are also difficult to manipulate.

SUMMARY OF THE INVENTION

Briefly stated, the invention contemplates the provision of an improved collapsible shipping container of the class described, in which the above-mentioned disadvantages have been substantially eliminated. To this end, the disclosed embodiment comprises a light-weight pallet. First and second wall elements have continuous lower edges which are secured to the upper surface of the pallet, in removable manner, the elements forming, when in erected condition, the side and end walls of the container, including one or more doors to provide entry. The free upper edges of the wall elements are permanently engaged by a flexible tempered roof element which may include textile materials, thus eliminating the need for elongated strap elements employed in my prior art construction. When the device is placed in collapsed condition, the body of the roof element is folded to substantially planar condition without detaching it from the wall elements for storage, and will normally be positioned between the wall elements which are also permanently interconnected. In a second embodiment, the roof element is selectively detachable when the container is collapsed.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
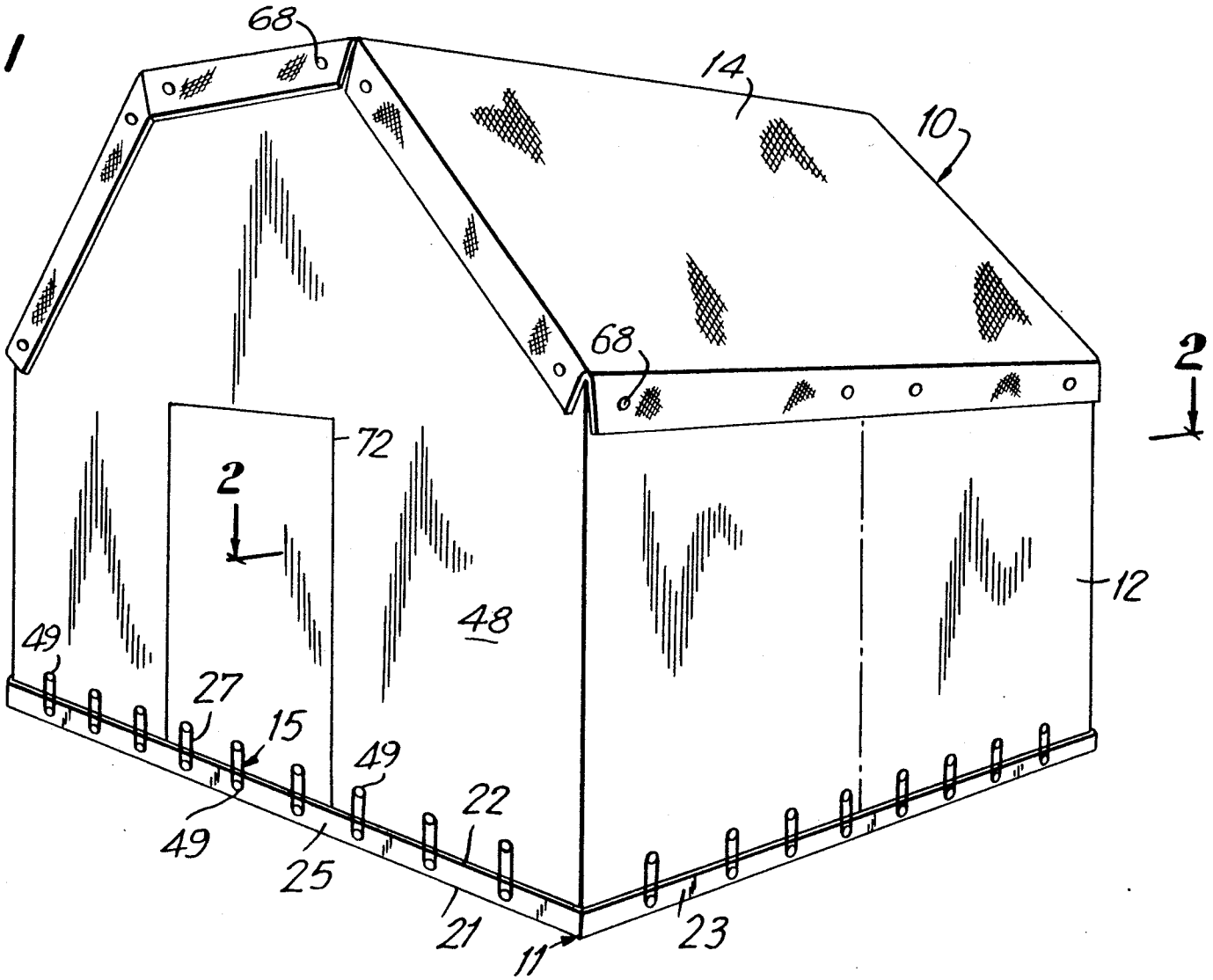
FIG. 1 is a view in perspective of an embodiment of the invention in fully erected condition.
Figure 2:
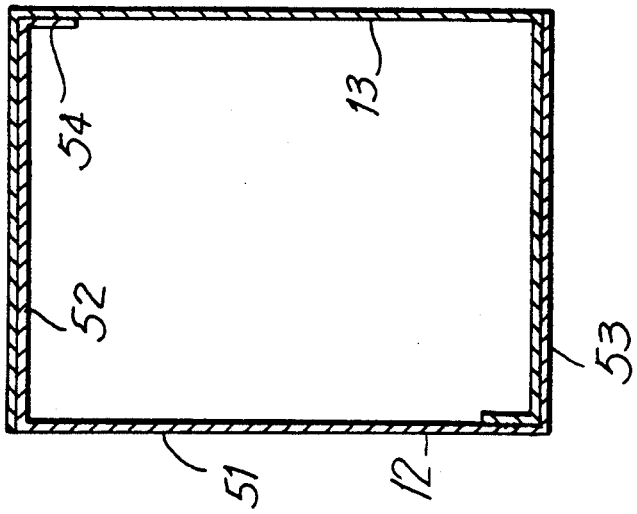
FIG. 2 is a horizontal sectional view thereof as seen from the plane 2—2 in FIG. 1.
Figure 3:
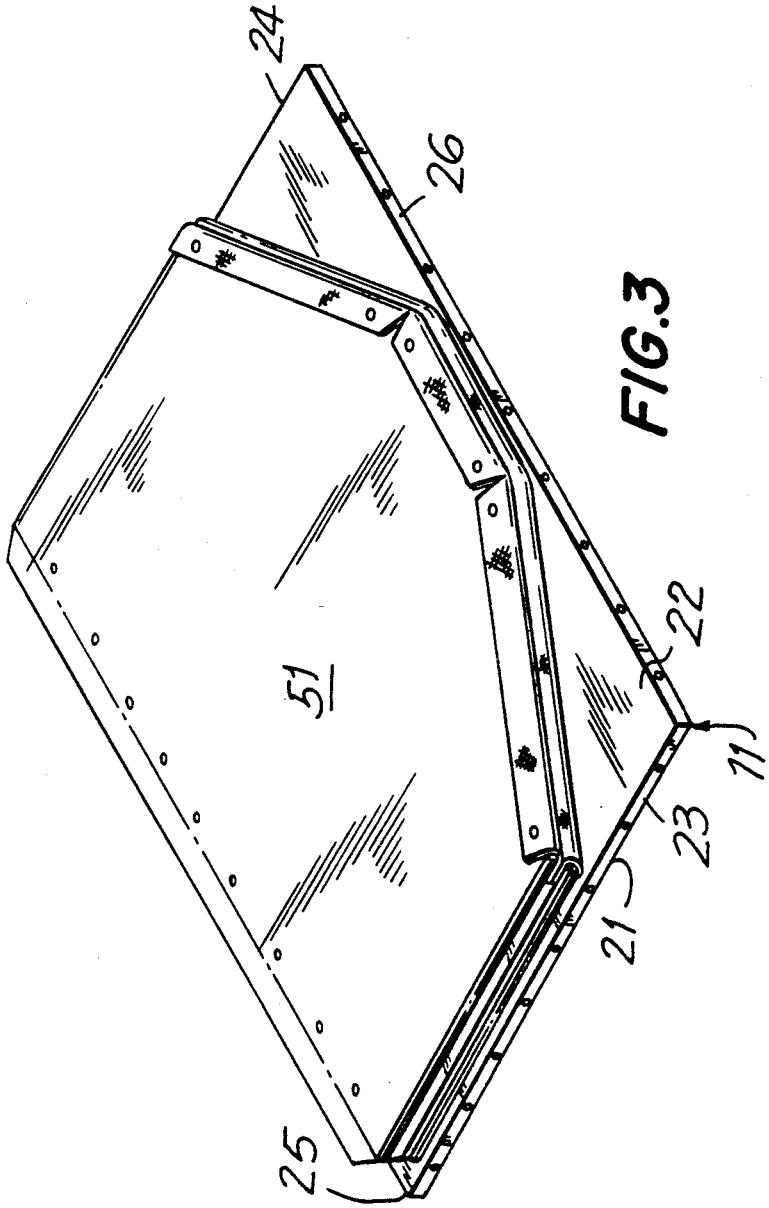
FIG. 3 is a view in perspective of the embodiment in collapsed condition with wall and roof elements in folded condition upon a pallet for storage or return shipment.

In accordance with the first embodiment of the invention, the device, generally indicated by reference character 10, comprises broadly: a planar pallet element 11, first and second wall elements 12 and 13, a roof element 14, and interconnected elements 15.

The pallet element 11 may be formed of corrugated materials, as is known in the art, and may be substituted by wood or aluminum materials, also of known type. The element 11 is bounded by a lower surface 21, an upper surface 22, first and second end edge surfaces 23 and 24, and first and second side edge surfaces 25 and 26. The edge surfaces 23–26 are provided with button type retaining members, 27 reference being made to any copending application Ser. No. 301,887 filed Feb. 21, 1992 which discloses interconnecting means of the type contemplated. However, less convenient threaded means may be used for interconnecting the slip sheet 11 to the wall elements 12 and 13, as is well known in the art.

The wall elements 12 and 13 are substantially identical, and, a description of one of these elements will serve equally well to describe the other. Each element is formed of a continuous blank of relatively rigid material, such as corrugated fiberboard, plastics, or aluminum. It is bounded by a continuous lower edge 31 which foldably mounts pallet element engaging flaps, 32, 33, 34, 35, and 36. The opposite ends of the blank are bounded by free edges 37 and 38.

A continuous upper free edge includes segments 40, 41, 42, 43, 44, 45, 46, and 47. Segments 43 and 45 are inclined, and form the domed portion of the container. An outer surface 48 mounts corresponding button fasteners 49 for the interconnection of resilient elements 15 used to selectively interconnect the wall elements with the slip sheet element.

Figure 4:
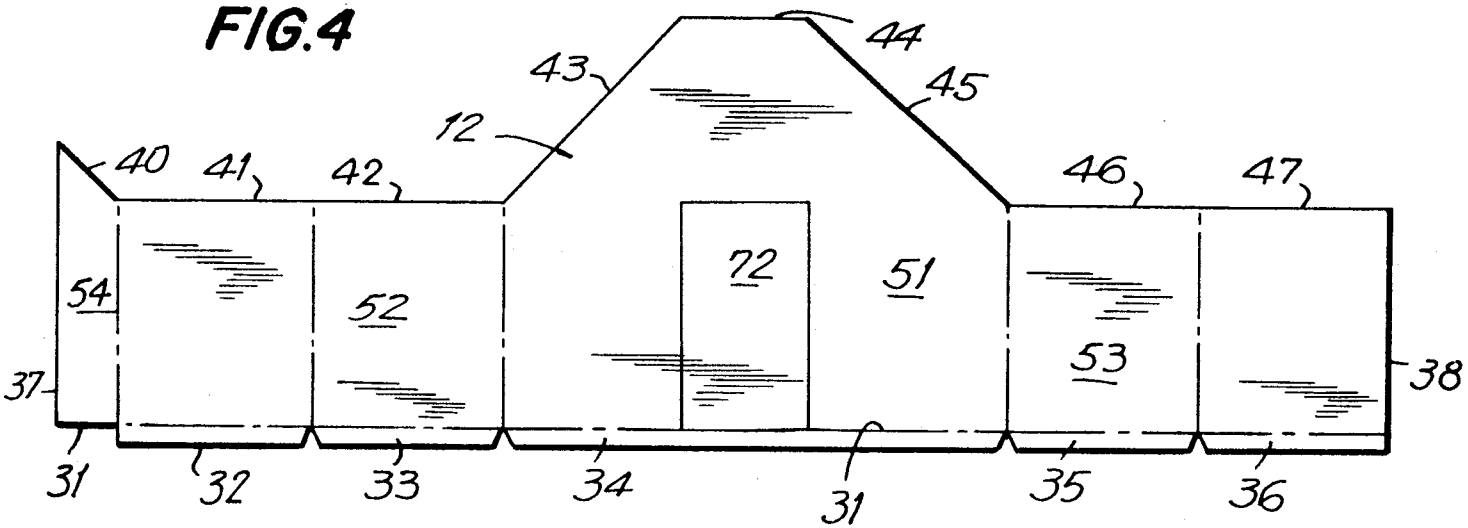
FIG. 4 is a developed view of a single wall element comprising a part of the embodiment.
Figure 6:
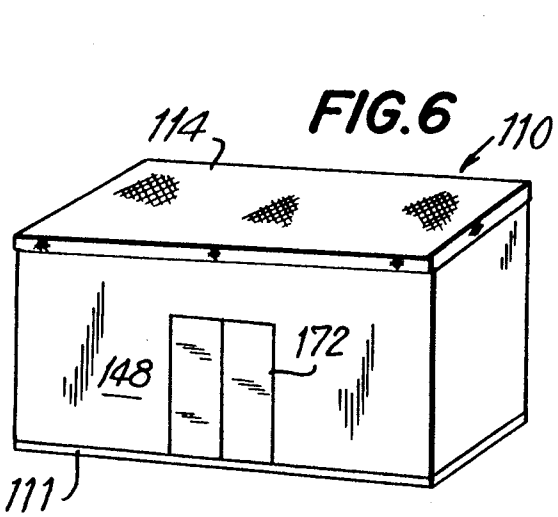
FIG. 6 is a perspective view of a second embodiment of the invention.

As best seen in FIG. 4, each wall element forms a main side wall panel 51, first and second foldable end wall panels 52 and 53 as well as an overlapping glue flap 54.

Figure 5:
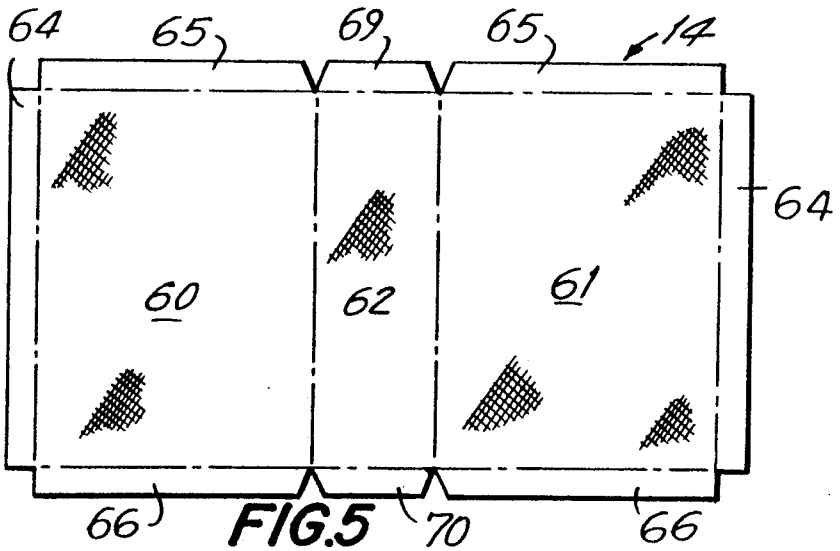
FIG. 5 is a developed view of a roof element forming another part of the embodiment.

The roof element 14, as has been mentioned, is made of non-rigid material, typically, a reinforced textile product having high tensile strength and weather resistant properties. Typical among such materials is one sold under the trademark Isoplan available from Hoecht-Celanese Corporation. Referring to FIG. 5, the element is generally rectangular in configuration, and forms first and second side panels 60 and 61 interconnected by a central panel 62. To provide for engagement with the edge segments 40–48, there is provided for each panel 60–61, an end flap 64, and first and second side flaps 65 and 66. These are secured to the outer surface 48 of the wall elements by fasteners 68 which are replaceable, but which are semi-permanent in nature, since it is not necessary to disconnect the roof element 14 when the device is collapsed. The central panel 62, in turn, has first and second side flaps 69 and 70 which are interconnected in a similar manner.

To provide ingress to the container when in assembled condition, one or more doors 72 are provided in one or both of the side wall panels 51 which may be secured in closed condition by any suitable means (not shown).

During disassembly, the elements 12 and 13 are disconnected from engagement with the pallet element 11. Next, the end wall panels 52 and 53 are folded inwardly to flatten them and place them in mutual juxtaposition. During this operation, the roof element 14, being flexible, will conveniently fold to planar condition, and in most cases, the bulk of the material comprising the roof element will be positioned between the side wall panels 51 in the upper area thereof above the now folded end wall panels. Any remaining material can be moved over the engaged upper edge segments and be disposed in flattened condition on an outer surface of the wall elements, following which the device may be placed in storage. To re-erect the device, the reverse procedure is followed, the wall elements 12 and 13 being first expanded prior to securing the same to the slip sheet element 11. This movement will normally expand the roof element 14 without further procedure.

Turning now to the second embodiment of the invention, parts corresponding to those of the first embodiment have been designated by similar reference characters with the additional prefix "1", thereby avoiding needless repetition.

The second embodiment differs from the first embodiment in that it is suitable for use in storage bay areas having a planar roof, or in bay areas sufficiently large that containers may be placed in stacked relation.

To this end, the side wall element eliminate the domed portions, and present a continuous upper edge which lies in a single horizontal plane. The roof element 114 is also made of similar non-rigid materials, and is interconnected so as to be collapsed in a similar manner to that of the first embodiment. Optionally, it may be provided with fasteners which are quickly detached.

Figure 7:
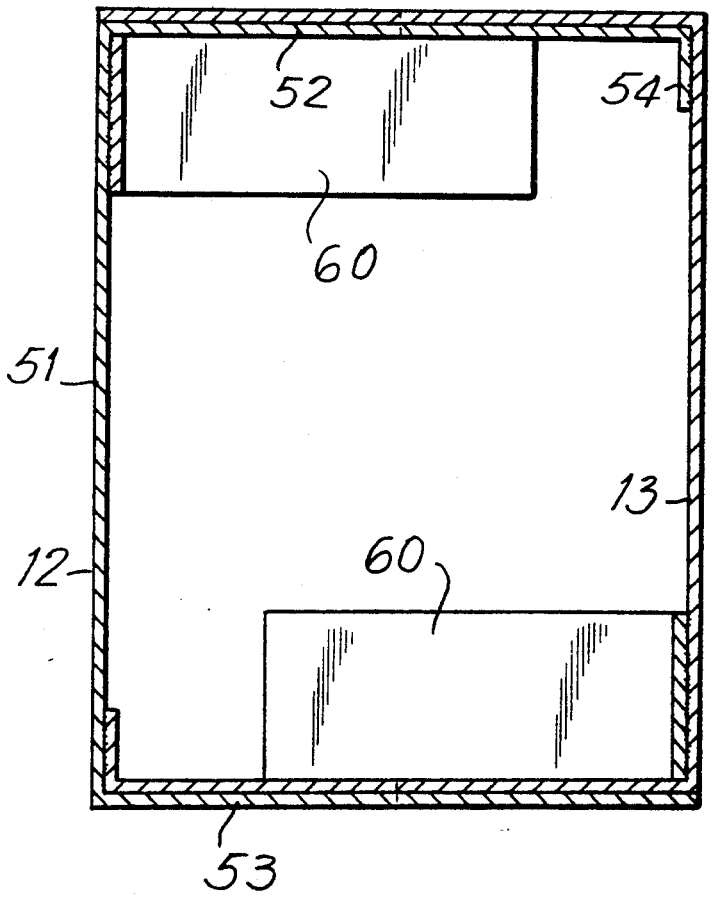
FIG. 7 is a horizontal sectional view corresponding to that seen in FIG. 2, but showing a modification thereof.

In the modification shown in FIG. 7, I have provided reinforcing flaps 60 attached to the upper inner surfaces of the side walls 12 and 13 for pivotal movement about horizontal axes. When in vertical orientation, the flaps will lie parallel to the planes of the side walls. When the container is in erected condition, the flaps are raised to horizontal orientation to contact the inner surfaces of the now erected side walls to prevent inward bowing along the fold edges prior to loading of the container.

I wish it to be understood that I do not consider the invention to be limited to the precise details of structure shown and set forth in the Specification, for obvious modifications will occur to those skilled in the art to which the invention pertains.

I claim:

1. An improved collapsible shipping container of domed roof configuration including: a rigid planar pallet element, first and second wall elements, and a roof element; said pallet element having a peripheral edge and means in the area of said edge for selectively interconnecting said edge with lower edges of said wall elements; said wall elements each comprising a blank of relatively rigid foldable material and including a side wall panel having a pair of converging edges and a horizontally oriented edge at an upper portion thereof; said wall elements each including an end wall panel of generally rectangular configuration and having a vertically oriented centrally positioned fold line therein; said side wall panel being of a height greater than that of said end wall panel; said roof element comprising a single blank of flexible material and including a roof member positioned to overlie the opening formed by said side wall panels in erected condition, and including first and second portions overlying the end wall panels of said wall elements, and a third portion, positioned therebetween, overlying the side wall panels thereof; said roof element being interconnected at the peripheral edges thereof to said wall panels; whereby, when said container is placed in collapsed condition, said wall elements are folded to parallel juxtaposed condition, and said roof element is flexed to folded condition parallel to said wall elements.

2. A container in accordance with claim 1, in which, upon collapsing said wall elements, said roof element remains in interconnected relation therewith.

3. A container in accordance with claim 1, in which said roof element is secured to said wall elements by threaded interconnecting means.

4. A container in accordance with claim 1, in which, upon collapsing said side wall elements, said roof element is placed in folded relation between said pair of wall elements.

5. An improved collapsible shipping container of flexible roof configuration, including a relatively rigid planar pallet element, first and second wall elements, and a roof element; said pallet element having a peripheral edge and means in the area of said edge for selectively interconnecting said edge with lower edges of said wall elements; said wall elements each comprising a blank of relatively rigid foldable material, and including side and end wall panels having a continuous horizontally oriented edge at an upper portion thereof; said wall elements each including an end wall panel of generally rectangular configuration and having a vertically oriented centrally positioned fold line therein; said roof element comprising a single blank of flexible material including peripheral edged portions overlying the upper edges of said wall elements; said roof element being interconnected at the peripheral edges thereof to said wall panels; whereby, when said container is placed in collapsed condition, said wall elements are folded to parallel juxtaposed condition, and said roof element is flexed to folded condition parallel to said wall elements.

6. A container in accordance with Claim 5, in which, upon collapsing said wall elements, said roof element remains in interconnected relation therewith.

7. An improved collapsible shipping container comprising: a rigid planar pallet element, first and second wall elements, and a roof element; said pallet element having a peripheral edge and means in the area of said edge for selectively interconnecting said edge with lower edges of said wall elements; said wall elements comprising a blank of relatively rigid foldable material and including a side wall panel having a horizontally oriented edge at an upper portion thereof; said wall elements each including an end wall panel of generally rectangular configuration and having a vertically oriented centrally positioned fold line therein, said roof element comprising a single blank of flexible material and including a roof member positioned to overlie the opening formed by said side wall panels in erected condition, said roof element being interconnected at the peripheral edges thereof to said wall panels, whereby, when said container is placed in collapsed condition, said wall elements are folded to parallel juxtaposed condition, and said roof element is flexed to folded condition parallel to said wall elements.

* * * * *